US005752358A

United States Patent [19]

Chadwick

[11] Patent Number: 5,752,358

[45] Date of Patent: May 19, 1998

[54] STRETCH WRAP DISPENSER HEAD WITH COATING APPLICATOR

[75] Inventor: Dennis P. Chadwick, Napanee, Canada

[73] Assignee: Chadwick Engineering Limited, Kingston, Canada

[21] Appl. No.: 779,431

[22] Filed: Jan. 7, 1997

[51] Int. Cl.[6] ..... B65B 53/00; B65B 29/00

[52] U.S. Cl. ..... 53/111 R; 53/556; 53/210; 53/211; 53/131.1; 53/402

[58] Field of Search ..... 53/556, 211, 401, 53/402, 411, 431, 111 RC, 111 R, 131.1, 128.1, 141, 409, 204, 383.1

[56] References Cited

U.S. PATENT DOCUMENTS

| | | | |
|---|---|---|---|
| T892,016 | 11/1971 | Hollander | 53/411 |
| 1,871,687 | 8/1932 | Hamersley | 53/411 |
| 2,533,704 | 12/1950 | Zanetti | 53/383.1 X |
| 3,453,797 | 7/1969 | Soto | 53/411 |
| 3,531,414 | 9/1970 | Randell | 53/402 X |
| 3,608,520 | 9/1971 | Caldwell . | |
| 3,648,428 | 3/1972 | Colburn . | |
| 3,721,804 | 3/1973 | Feldman . | |
| 3,784,004 | 1/1974 | Meyer . | |
| 4,135,782 | 1/1979 | Straughan . | |
| 4,310,367 | 1/1982 | Berejka . | |
| 4,418,100 | 11/1983 | Bedwell . | |
| 4,432,185 | 2/1984 | Geisinger . | |
| 4,443,501 | 4/1984 | Mino . | |
| 4,472,468 | 9/1984 | Tailor . | |
| 4,565,051 | 1/1986 | Back | 53/211 X |
| 4,572,868 | 2/1986 | Hosaka . | |
| 4,601,157 | 7/1986 | Adelman . | |
| 4,619,102 | 10/1986 | Geisinger . | |
| 4,728,532 | 5/1988 | Koopman . | |
| 4,864,802 | 9/1989 | D'Angelo . | |
| 4,912,911 | 4/1990 | Down | 53/211 X |
| 5,175,032 | 12/1992 | Steele . | |
| 5,300,356 | 4/1994 | Dempster . | |
| 5,328,743 | 7/1994 | Wynne . | |
| 5,351,461 | 10/1994 | Fandard et al. | 53/556 X |
| 5,411,777 | 5/1995 | Steele . | |

*Primary Examiner*—Linda Johnson
*Attorney, Agent, or Firm*—Richard J. Hicks

[57] ABSTRACT

A device for coating film passing through a continuous film dispensing head on a coil wrapping machine with a liquid formulation, such as a vapour phase corrosion inhibitor, is described. The formulation is delivered from a reservoir to an applicator bar which is urged into contact with the passing film. Flow of formulation can be established or interrupted while the film is enshrouding the coil.

4 Claims, 2 Drawing Sheets

STRETCH WRAP DISPENSER HEAD WITH COATING APPLICATOR

CROSS REFERENCE TO RELATED APPLICATION

This application is related to my earlier filed U.S. patent application 08/643,750 filed 6 May 1996, the disclosure of which is hereby incorporated by reference.

FIELD OF INVENTION

This invention relates to a stretch film wrap dispensing head which incorporates a device for applying a liquid coating to selected portions of the film as it is dispensed. More particularly, this invention relates to coating a film with a liquid Vapour Corrosion Inhibitor (VCI coating).

BACKGROUND OF INVENTION

Coils of continuous flexible materials, such as metal cables, wires, chain and most particularly metal strip are conventionally wrapped in a substantially water impermeable, pliable flexible wrapping material to provide protection during shipping and hanling operations. Conventionally, a stretch wrap thermoplastics film, such as polyvinyl chloride or polyethylene, which is chemically inert, proof against water, and other liquids, vapours and gases and which tends to cling to itself is employed. The film is stretched prior to or during application to the coil of material to be protected and due to its property of "memory", it then seeks to return to its unstretched state and thus adheres tightly to the coil. There are several ways to apply the film material known in the art, and a particularly popular method is known as cocoon wrapping wherein a strip of film is wound continuously around the coil which is rotated about an axis perpendicular to the axis of wrap application during wrapping so that eventually the entire peripheral surface of the coil is covered by the film. Cocoon wrapped coils are, however, relatively difficult to handle after wrapping as the open centre of the coil is also generally covered with film. "Through-the-eye" wrapping avoids the problem of covering the centre of the coil and facilitates lifting with a finger or horn on a fork lift truck or the like. Both cocoon and through-the-eye wrapping affords considerable protection but conditions of application may not be ideal, seals may not be entirely hermetically complete or minor rips and tears may occur, allowing ingress of water vapour or other corrosive gases. Accordingly, it is common practice to use a film wrapping material which has been precoated with a VCI material, such as CORTEC VCI-350 or 351 manufactured by Cortec Corporation, St. Paul, Minn. Such precoated films are, however, relatively expensive and only the VCI in the layer in immediate contact with the metal of the coil is effective in preventing corrosion. The VCI in the outer layers is prevented from reaching the metal surface by the impermeable nature of the film material. There is a need, therefore, for a means to apply a VCI or other coating material to the film material as it is being dispensed. This provides great flexibility of application of any desired type of coating to any selected area or length of the film.

OBJECT OF INVENTION

An object of the present invention is to provide means for coating a stretch wrap film or the like with a liquid coating material, such as VCI or the like, in situ as the film is being applied to an object, such as a metal coil of strip.

BRIEF STATEMENT OF INVENTION

By one aspect of this invention there is provided an apparatus for wrapping a cylindrical object with a flexible protective film, comprising means for rotating said cylindrical object about its longitudinal axis and film dispensing means rotatable about an axis perpendicular to said longitudinal axis for supplying film to said rotating cylindrical object so as to enshroud said object therein; the improvement comprising a liquid formulation delivery means to an applicator bar means, mounted on said rotatable film dispensing means, said applicator bar means being resiliently mounted for contact with said flexible protective film intermediate said film dispensing means and said cylindrical object.

DETAILED DESCRIPTION OF PREFERRED EMBODIMENTS

Figure 1:
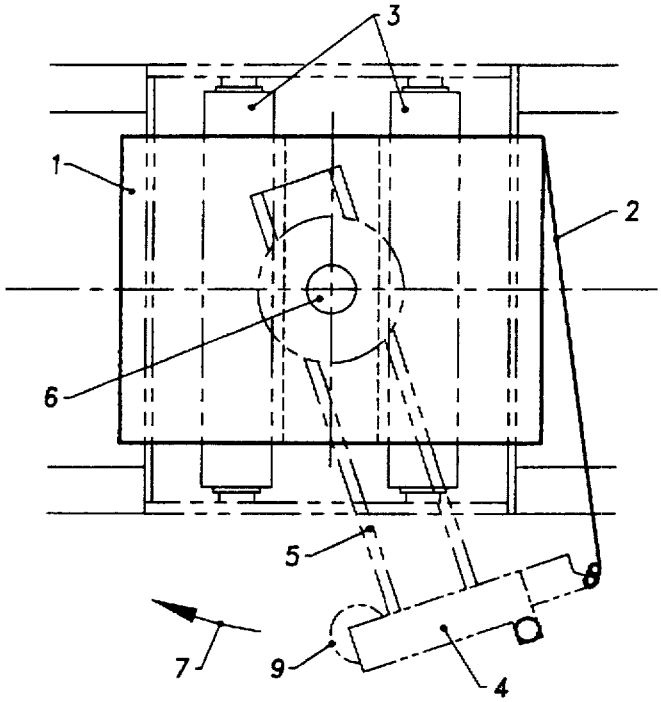
FIG. 1 is a schematic plan view of a coil wrapping machine, including a film dispensing head.

In FIG. 1 there is shown, in phantom, a coil of metal strip 1, such as aluminum strip or steel strip, to be wrapped in a protective film wrapping 2. The coil 1 is supported on rolls 3 which rotate about a horizontal axis so as to rotate the coil 1. A conventional film dispensing head 4, such as supplied by Wulftec International, Montreal, Canada, is mounted on arm 5 which rotates about a vertical axis 6 above coil 1, in the direction of the arrow 7, so as to completely cocoon wrap the coil 1 in film 2, as described in more detail in the co-pending U.S. application Ser. No. 08/643,750 referred to above. Several layers of film 2 are wrapped around coil 1 in order to form a tightly sealed package.

Figure 2:
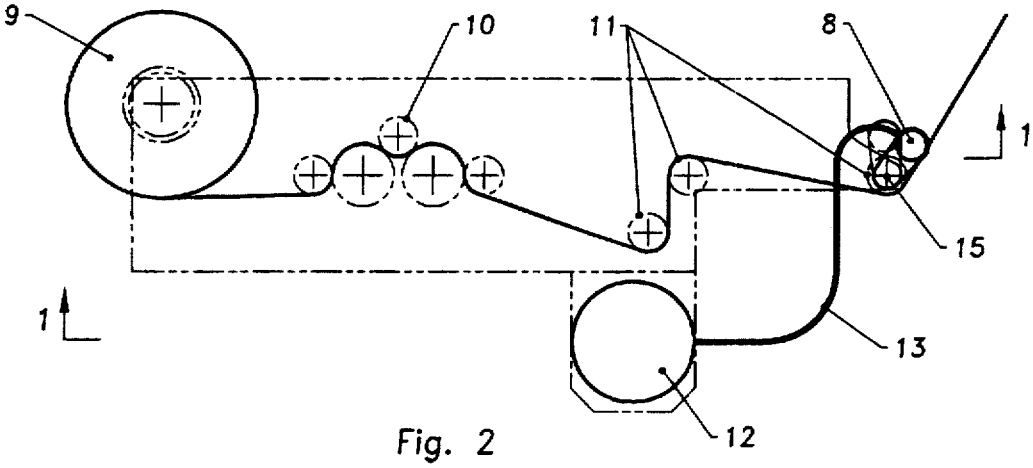
FIG. 2 is an enlarged plan view of the film dispensing head of FIG. 1.
Figure 3:
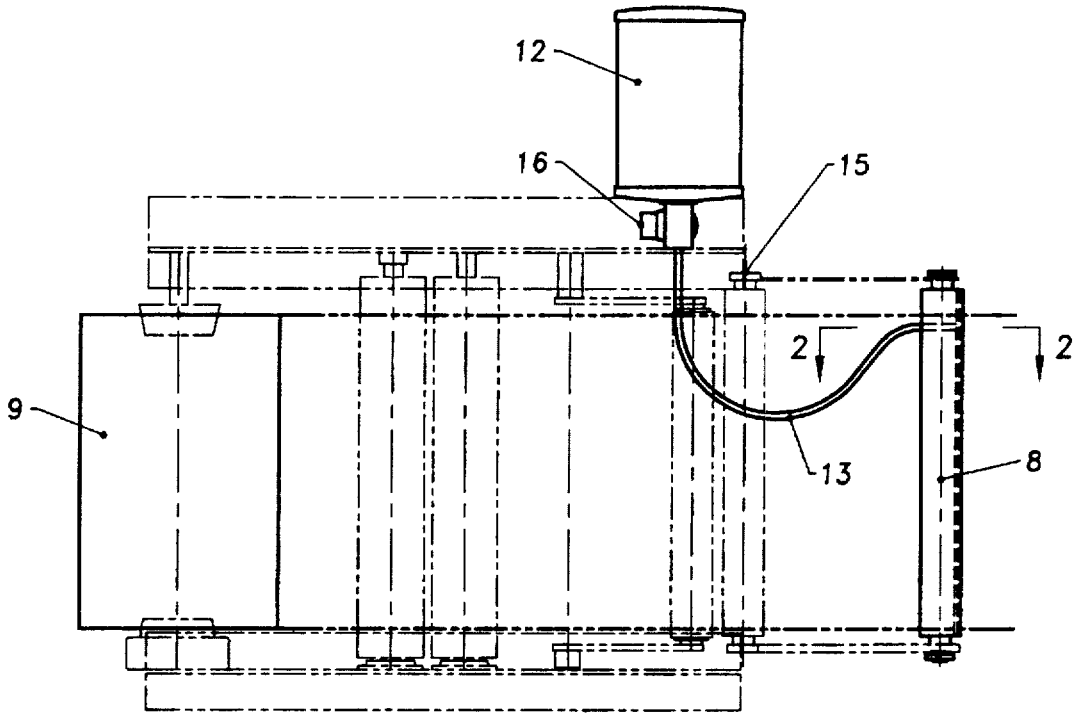
FIG. 3 is a sectional view of the dispenser head of FIG. 2 taken along section line A—A.
Figure 4:
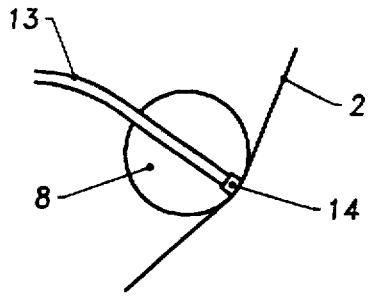
FIG. 4 is an enlarged sectional view of the dispenser head of FIG. 3 taken along section line B—B.

The film to be applied is coated with either a solvent based (VCI-351) or water based (VCI-350) formulation or the like from the in-line applicator bar 8, as seen more clearly in FIGS. 2 and 3, as the film 2 is dispensed from film coil 9 over rolls 10 and 11 to the coil 1. The VCI formulation is contained in a reservoir 12 mounted on the film dispensing head 4 and is fed via a flexible tube 13 to a groove 14 (see FIG. 4) provided in applicator bar 8. Applicator bar 8 is preferably pivotally mounted about a vertical axis 15 on head 4 and adapted to maintain close contact with film 2. The formulation flows, preferably under gravity, to the top of groove 14 and flows downwardly therealong to be picked up by the passing film. The flow may be shut off by valve 16 so that little or no wastage occurs as drips from the lower end of groove 14. Metering means (not shown) may be included to control the quantity of formulation applied to the film. When the first layer of film 2 completely enshrouds coil 1, the supply of formulation to groove 14 is terminated by shutting valve 16 and wrapping continues with non-coated film until the desired thickness of film has been applied. It will be appreciated that the formulation can be applied to any selected length of the film.

I claim:

1. In an apparatus for wrapping a cylindrical object with a flexible stretch wrap protective film, comprising means for rotating said cylindrical object about its longitudinal axis and film dispensing means rotatable about an axis perpendicular to said longitudinal axis for supplying film to said cylindrical object while it is rotating so as to enshroud said object therein; the improvement comprising applicator bar means mounted, on said rotatable film dispensing means, for contact with an inside surface of said flexible protective film, intermediate said film dispensing means and said cylindrical object, and delivery means, mounted on said rotatable film dispensing means, for delivery of a corrosion inhibiting formulation to said applicator bar means at any selected interval of time during said wrapping, and so as to apply said corrosion inhibiting formulation directly to said cylindrical object.

2. An apparatus as claimed in claim 1, including flexible tube means providing a liquid flow path between said liquid dispensing means and said applicator bar means.

3. An apparatus as claimed in claim 2 wherein said applicator bar means includes a longitudinally extending groove in liquid connection with said liquid flow path.

4. An apparatus as claimed in claim 3, including shut-off valve means in said liquid flow path.

* * * * *